US008866456B2

(12) United States Patent
Kadanka et al.

(10) Patent No.: US 8,866,456 B2
(45) Date of Patent: Oct. 21, 2014

(54) METHOD OF FORMING A POWER SUPPLY CONTROLLER AND STRUCTURE THEREFOR

(75) Inventors: Petr Kadanka, Valasska Bystrice (CZ); Pavel Londak, Hutisko Solanec (CZ)

(73) Assignee: Semiconductor Components Industries, LLC, Phoenix, AZ (US)

( * ) Notice: Subject to any disclaimer, the term of this patent is extended or adjusted under 35 U.S.C. 154(b) by 318 days.

(21) Appl. No.: 13/473,336

(22) Filed: May 16, 2012

(65) Prior Publication Data

US 2013/0307501 A1 Nov. 21, 2013

(51) Int. Cl.
*G05F 1/56* (2006.01)

(52) U.S. Cl.
USPC ..... 323/273; 323/280; 323/901

(58) Field of Classification Search
CPC ..... G05F 1/468
USPC ..... 323/273–281
See application file for complete search history.

(56) References Cited

U.S. PATENT DOCUMENTS

| | | | | |
|---|---|---|---|---|
| 6,150,800 | A * | 11/2000 | Kinoshita et al. | 323/280 |
| 2004/0027106 | A1* | 2/2004 | Martins | 323/282 |
| 2010/0320993 | A1* | 12/2010 | Yoshii | 323/312 |
| 2011/0156672 | A1 | 6/2011 | Gakhar et al. | |
| 2012/0098508 | A1* | 4/2012 | Zhu | 323/272 |

* cited by examiner

*Primary Examiner* — Harry Behm
(74) *Attorney, Agent, or Firm* — Robert F. Hightower

(57) ABSTRACT

In one embodiment, a method of forming a power supply controller may include configuring the power supply controller to control a pass transistor to form an output current responsively to a control signal and independently of the value of the output voltage until the control signal is less than a deviation from a desired value of the output voltage.

20 Claims, 4 Drawing Sheets

METHOD OF FORMING A POWER SUPPLY CONTROLLER AND STRUCTURE THEREFOR

BACKGROUND OF THE INVENTION

The present invention relates, in general, to electronics, and more particularly, to semiconductors, structures thereof, and methods of forming semiconductor devices.

In the past, the semiconductor industry utilized various methods and structures to form linear voltage regulators including low dropout linear voltage regulators. In some embodiments, the regulator included an enable input that was utilized to enable and disable the regulator from regulating the output voltage. When the regulator became enabled, there typically was a large inrush of current in order to charge an output capacity that was connected to the regulator. This large inrush current is undesirable, and in some cases could cause improper operation of the system that uses the regulator.

Accordingly, it is desirable to have a regulator that can minimize the value of the inrush current.

Figure 1:
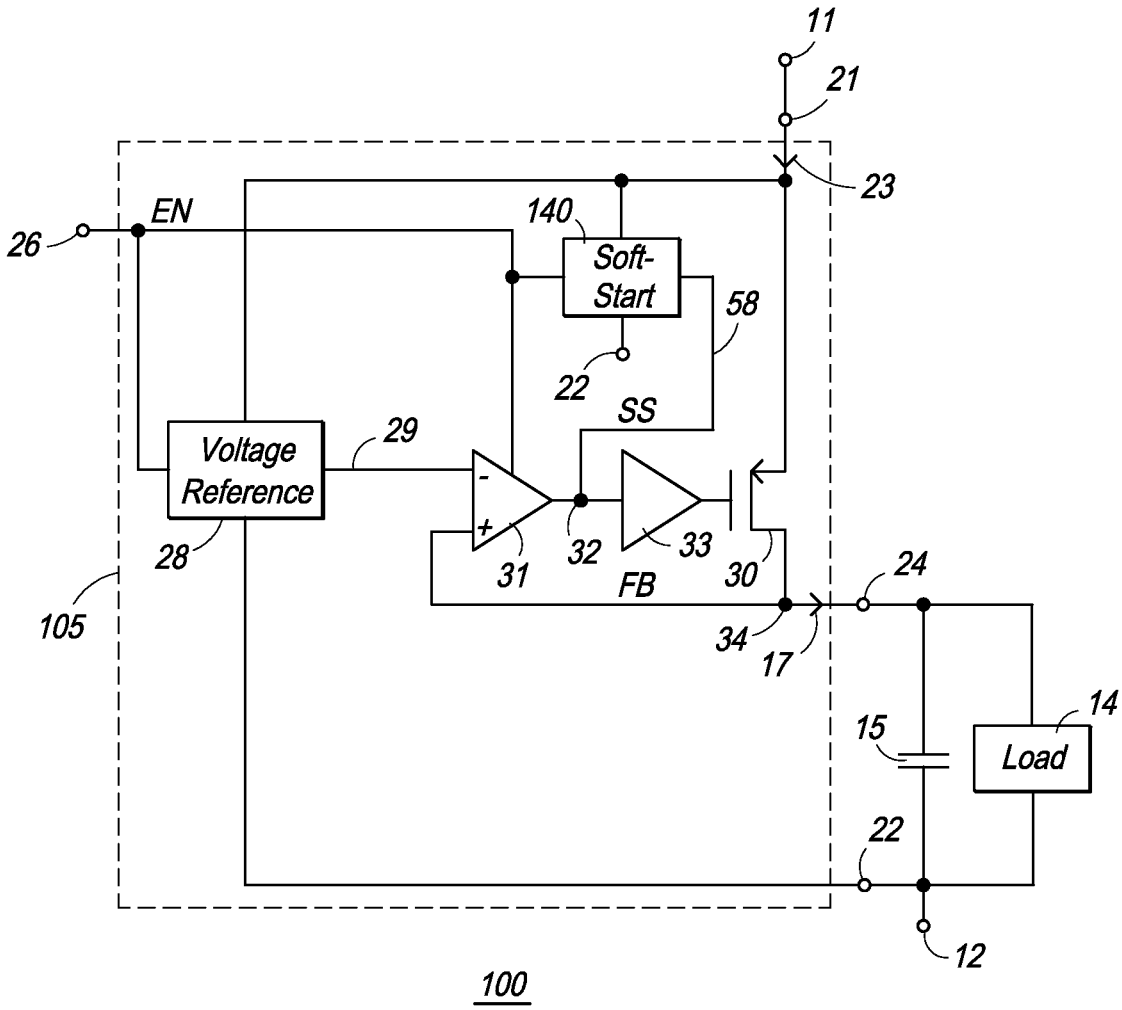
FIG. 1 schematically illustrates an example of an embodiment of a linear power supply system in accordance with the present invention.

For simplicity and clarity of the illustration(s), elements in the figures are not necessarily to scale, and the same reference numbers in different figures denote the same elements, unless stated otherwise. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-Channel devices, or certain N-type or P-type doped regions, a person of ordinary skill in the art will appreciate that complementary devices are also possible in accordance with the present invention. One of ordinary skill in the art understands that the conductivity type refers to the mechanism through which conduction occurs such as through conduction of holes or electrons, therefore, and that conductivity type does not refer to the doping concentration but the doping type, such as P-type of N-type. It will be appreciated by those skilled in the art that the words during, while, until, and when as used herein relating to circuit operation are not exact terms that mean an action takes place instantly upon an initiating action but that there may be some small but reasonable delay, such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten per cent (10%) (and up to twenty per cent (20%) for semiconductor doping concentrations) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein.

DETAILED DESCRIPTION OF THE DRAWINGS

FIG. 1 schematically illustrates an example of an embodiment of a linear power supply system 100 that is utilized to regulate an output voltage supplied to a load 14. System 100 includes an input terminal 11 that is connected to receive power from an input voltage and includes a common return terminal 12 that is utilized to form a return path to the input voltage. A linear power supply controller 105 is utilized to control an input current 23 to form a load current 17 and regulate the value of the output voltage supplied to load 14. Controller 105 includes a voltage input 21 that is connected to receive the input voltage from terminal 11 and also includes a common return 22 that is connected to a common return such as terminal 12. Controller 105 typically includes a voltage reference 28, a series pass transistor 30, an error amplifier 31, and a soft-start circuit 140. Controller 105 may also include an optional buffer 33. An enable input 26 of controller 105 is configured to receive an enable (EN) signal wherein controller 105 is configured to inhibit enabling transistor 30 in response to a negated state of the enable (EN) signal. Reference 28 forms a reference voltage 29 on an output of reference 28. Reference 28 typically is a fixed voltage reference such as a bandgap regulator or other such a fixed reference. In some embodiments, reference 28 may be a variable reference that forms voltage 29 to vary or may be another type of well-known reference. Controller 105 uses a feedback (FB) signal that is representative of the output voltage to assist in regulating the output voltage, such as the voltage on an output 24, to a desired value. Those skilled in the art will understand that the output voltage is regulated to the desired value or target value within a range of values around the target value. For example, the target value may be three volts (3V) and the range of values may be plus or minus five percent (5%) around the three volts. As will be appreciated by those skilled in the art, the feedback (FB) signal may be the value of the output voltage as illustrated in FIG. 1, or may be a different signal such as a voltage divided value of the output voltage or a signal derived from the output voltage by an optical coupler. Amplifier 31 forms an error signal 32 on an output of amplifier 31 that is representative of a difference between the value of voltage 29 and the feedback (FB) signal or is representative of a deviation from the desired value of the output voltage. One of ordinary skill in the art will appreciate that since controller 105 is a liner power supply controller, in normal operation the value of error signal 32 varies in a substantially linear manner. Those skilled in the art will appreciate that in other embodiments the signal that is representative of the deviation from the desired value of the output voltage may be formed by other well-known means such as any difference circuit that is configured to form a signal that is representative of the deviation from the desired value of the output voltage or the difference between the value of the output voltage and the desired value of the output voltage.

Reference 28, amplifier 31, and circuit 140 receive the enable (EN) signal from input 26. In response to a negated state of the enable (EN) signal, reference 28 inhibits forming voltage 29, and amplifier 31 is disabled and does not provide an output signal to control transistor 30. Also in response to the negated state of the enable (EN) signal, circuit 140 forms a soft-start (SS) signal 58 with a value that disables transistor 30, thus, controller 105 does not regulate the value of the output voltage and does not provide current 17 to load 14 or to charge capacitor 15.

One embodiment of a method of forming circuit 140 includes configuring circuit 140 to form a control signal responsively to an asserted state of the enable signal (EN) wherein the control signal varies from a first value to a second value at a first rate and uses the control signal to control transistor 30 to form current 17 responsively to the control signal.

Another embodiment includes that the control signal is not the error signal nor derived from the error signal of amplifier 31.

Another method of forming controller 105 may include configuring controller 105 to form a control signal responsively to an asserted state of the enable signal wherein the control signal varies from a first value to a second value; and configuring controller 105 to control transistor 30 to form the value of current 17 responsively to the control signal and independently of the value of the output voltage until the control signal is less than the feedback signal.

Figure 2:
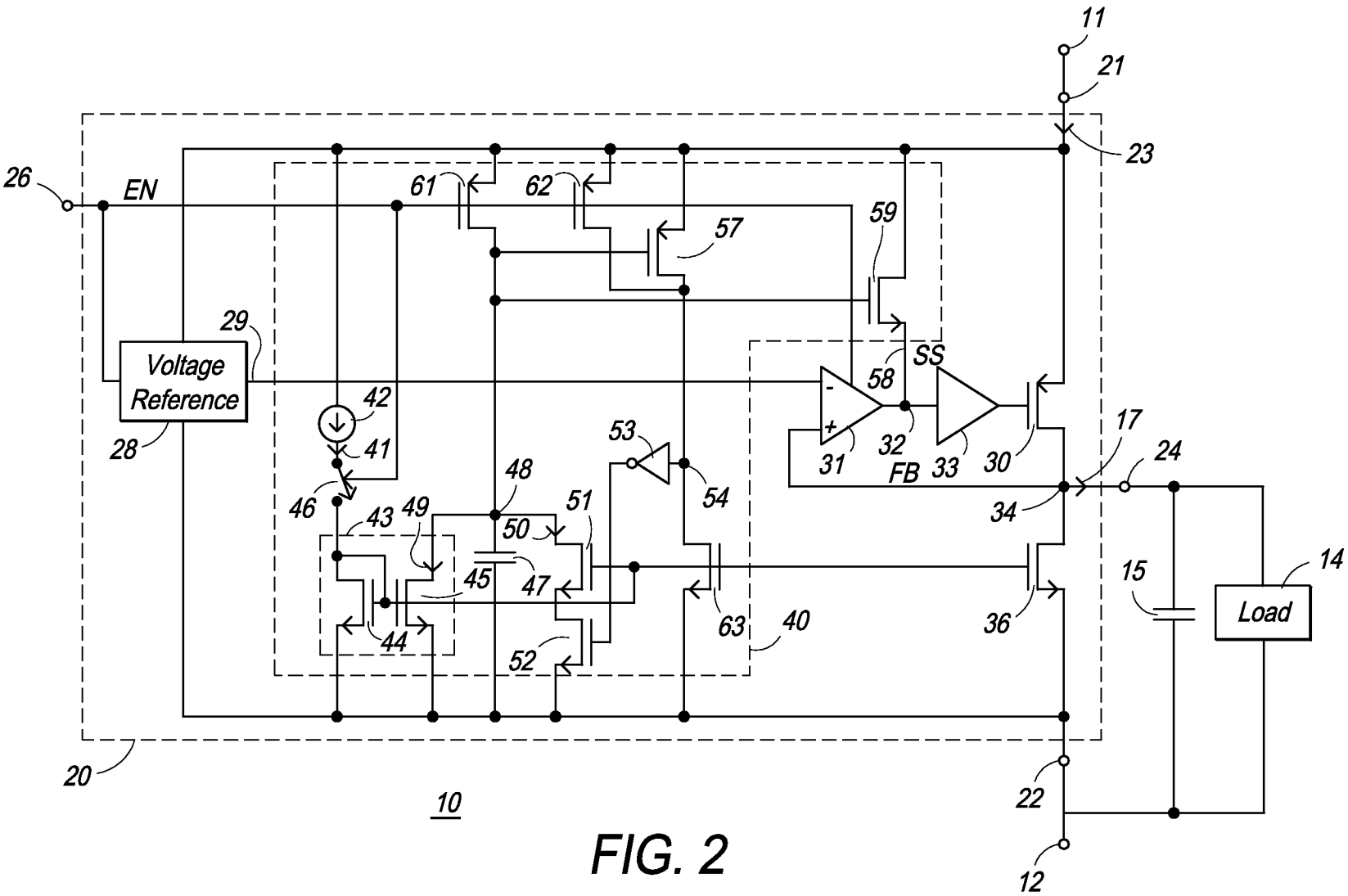
FIG. 2 schematically illustrates an example of an embodiment of another power supply system that is an alternate embodiment of the system of FIG. 1 in accordance with the present invention.

FIG. 2 schematically illustrates an example of an embodiment of a power supply system 10 that is an alternate embodiment of system 100 and that is substantially the same as and functions substantially the same as system 100. System 10 includes a linear power supply controller 20 that is substantially the same as and functions substantially the same as controller 105. Controller 20 includes a soft-start circuit 40 that is substantially the same as and functions substantially the same as circuit 140. For the example embodiment illustrated in FIG. 2, circuit 40 is configured to form a control signal 48 having a ramp waveshape, thus, the elements illustrated in FIG. 2 are configured to form such a waveshape. In other embodiments, control signal 48 may have other waveshapes, such as an asymptotically varying waveshape, and the elements of such a circuit 40 would be different than those illustrated in FIG. 2 and would be configured to form such a waveshape. The example embodiment of circuit 40 illustrated in FIG. 2 includes a current source 42, a switch 46, a current mirror 43, a ramp capacitor 47, transistors 51 and 52, an inverter 53, transistors 61-63, transistor 57, and an enable transistor 59. Controller 20 may also include an optional transistor 36 that is configured to form a current sink for transistor 30. In some embodiments, transistor 36 may be omitted or may be configured as another type of device, such as a resistor.

It will be seen further hereinafter that controller 20 or controller 105 may comprise: a feedback (FB) node 34 configured to form a feedback (FB) signal that is representative of the output voltage wherein the controller is configured to regulate a voltage on the control electrode of transistor 30 in response to the FB signal. Controller 20 is configured to inhibit enabling transistor 30 in response to a negated state of the enable (EN) signal; controller 20 is configured to form control signal 48 as a ramp signal that varies at a first rate responsively to an asserted state of the enable (EN) signal; and transistor 59 is configured to vary a voltage on the control electrode of transistor 30 responsively to the variation of the ramp signal and independently of the value of the FB signal until a difference between the FB signal and the ramp signal reaches a threshold voltage of transistor 59.

Figure 3:
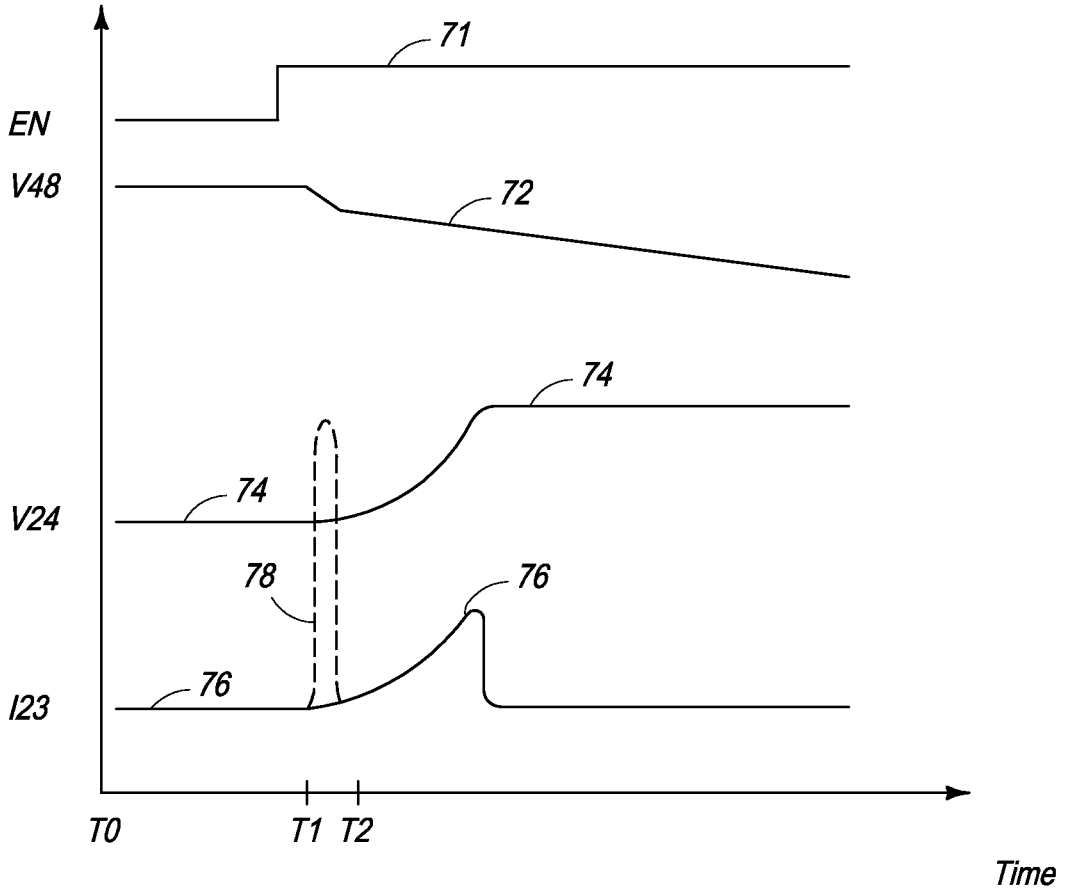
FIG. 3 is a graph having plots that illustrate some of the signals of the systems of FIG. 1 and FIG. 2 in accordance with the present invention.

FIG. 3 is a graph having plots that illustrate some of the signals of system 10 and of controller 20. The abscissa indicates time and the ordinate indicates increasing value of the illustrated signal. A plot 71 illustrates the EN received on input 26, a plot 72 illustrates control signal 48, a plot 74 illustrates the output voltage, and a plot 76 illustrates input current 23. This description has references to FIGS. 2 and 3. Those skilled in the art will appreciate that there may be some delay time between the times and the actual change of the signal illustrated in FIG. 3, thus, FIG. 3 may not be exactly to scale for clarity of the description.

At a time T0, assume that the input voltage on terminal 11 is sufficient for operating controller 20 and that the EN signal is negated. With EN negated, reference 28 and amplifier 31 are disabled. The negated EN signal also enables transistors 61 and 62. Enabled transistor 61 pulls control signal 48 to substantially the input voltage on input 21 and charges capacitor 47 substantially to that value. The high value of signal 48 disables transistor 30. The high value of signal 48 also enables transistor 59. Transistor 59 forms soft-start (SS) signal 58 to have a value that disables transistor 30. With transistor 30 disabled, capacitor 15 discharges and the output voltage is low as illustrated by plot 74 along with the FB signal. Enabled transistor 62 pulls the input of inverter 53 high which disables transistor 52. The negated EN signal causes controller 20 to responsively disable circuit 40 from charging capacitor 47. The negated state of the EN signal also disables switch 46 which disconnects circuit 40 from charging capacitor 47. Disabling switch 46 and transistor 52 allows capacitor 47 to charge to the value of substantially the input voltage.

Assume that at a time T1, the EN signal becomes asserted. Asserting EN enables reference 28 to form reference voltage 29 and enables amplifier 31 to form error signal 32 representing the deviation from the desired value of the output voltage or the difference between the output voltage and the desired value of the output voltage. Those skilled in the art will appreciate that in other embodiments the signal that is representative of the deviation from the desired value of the output voltage may be formed by other means than by using an amplifier such as amplifier 31. Because the output voltage is low, the value of error signal 32 is also low which would try to drive transistor 30 to supply a large current. Such a condition could result in current 23 having a very large value or large inrush current. Circuit 40 is configured to control transistor 30 to control the value of current 23 to minimize the value of the inrush current.

The asserted state of the EN signal also enables circuit 40 to form signal 48 to vary from a first value to a second value. For the example embodiment of circuit 40 illustrated in FIG. 2, asserting EN disables transistors 61 and 62. Asserting EN also closes switch 46 to cause current 41 to flow through transistor 44. The current mirror configuration of transistors 44 and 45 causes a current 49 to flow through transistor 45. With transistor 62 disabled, the input of inverter 53 is asserted which results in enabling transistor 52. With transistor 52 enabled, the current mirror configuration of transistor 51 with transistor 44 causes a current 50 to flow through transistor 51. Currents 49 and 50 discharge capacitor 47 and cause signal 48 to vary from a first value to a second value as illustrated by plot 72 near time T1. For the embodiment illustrated in FIG. 2, signal 48 varies from a high value to a lower value. Those skilled in the art will appreciate that other signal values could be used, for example, in another circuit embodiment, signal 48 may vary for a low value to a higher value. Since transistor 59 is configured as a voltage follower, transistor 59 controls the gate of transistor 30 to vary in the same manner as signal 48. Thus, transistor 59 controls soft-start (SS) signal 58 to vary with a voltage that is substantially the same as signal 48 less the gate-to-source voltage of transistor 59. As the value of signal 48 decreases, the on-resistance of transistor 30 decreases so that transistor 30 can conduct more current as illustrated by plot 76 between times T1 and T2. Those skilled in the art will appreciate that even though transistor 59 is configured in a voltage follower configuration, for other embodiments the enable transistor may have a different configuration than a voltage follower. Controlling signal 48 to vary at the first rate results in slowly increasing the value of current 17, thus current 23, thereby minimizing the inrush current. As the value of signal 48 continues to decrease at the first rate, control signal 48 eventually becomes less than the threshold voltage of transistor 57 which causes transistor 57 to be enabled. Enabling transistor 57 causes the input of inverter 53 to become asserted which negates the output thereby disabling transistor 52. Disabling transistor 52 inhibits current 50 which results in capacitor 47 discharging at a second rate which results from the value of current 49 as illustrated by plot 72 near time T2. Transistor 59 continues to control transistor 30 responsively to the value of signal 48 which now causes the on-resistance of transistor 30 to vary at the second rate and slowly increase the value of currents 17 and 23 as illustrated near time T2. The output voltage increases at the rate determined by current 17 as illustrated by plot 74. As will be appreciated by those skilled in the art, as the value of the output voltage increases, the drain voltage of transistor 30 also increases. Configuring circuit 20 to vary the control signal at two different rates facilitates increasing the time utilized to charge capacitor 15 and also decreases the rate of change of current 17 at the second rate.

Controlling transistor 30 to form current 17 responsively to signal 48 and independently of the value of the output voltage until an output threshold voltage of circuit 40 is less than the error signal or less than the deviation from the desired value of the output voltage facilitates decreasing the value of the inrush current as transistor 30 is slowly enabled. Those skilled in the art will appreciate that for the embodiment illustrated in FIG. 2, the output threshold voltage of circuit 40 is approximately the threshold voltage of transistor 59. However, in other embodiments, the output threshold voltage may be formed by other circuits such as a bipolar transistor or a comparator instead of transistor 59. Plot 78 illustrates in dashed lines the value of current 23 as transistor 30 is enabled without the functions of circuit 40 or circuit 140 (FIG. 1). Plot 76 illustrates that circuit 40 controls the value of the inrush current to slowly increase so that the peak value is controlled to be much less than the value without circuit 40. In one example embodiment, it was found that the inrush value of current 23 was an order of magnitude less with circuit 40 than it was without circuit 40.

Controller 20 continues to control transistor 30 responsively to the control signal and independently of the value of the output voltage until the error signal becomes greater than the output threshold voltage of circuit 40. As the output voltage increases to the output threshold voltage of circuit 40, the voltage on the source of transistor 59 becomes large enough that transistor 59 is disabled and no longer control transistor 30, thus, controller 20 begins to regulate the output voltage responsively to the error signal from amplifier 31.

In order to facilitate the functionality described hereinbefore, enable input 26 is connected to an enable input of reference 28, to an enable input of circuit 40, and to an enable input of amplifier 31. An output of amplifier 31 is connected to an output of circuit 40 and to an input of buffer 33 which has an output connected to a gate of transistor 30. A source of transistor 30 is connected to input 21 and a drain is commonly connected to output 24, node 34, and a non-inverting input of amplifier 31. An inverting input of amplifier 31 is connected to an output of reference 28. A first terminal of source 42 is connected to input 21 and a second terminal is connected to a first terminal of switch 46. A control terminal of switch 46 is connected to the enable input of circuit 40. A second terminal of switch 46 is commonly connected to a drain and gate of transistor 44, and to a gate of transistors 45, 51, and 63. A source of transistor 44 is commonly connected to a return terminal of reference 28, return 22, the first terminal of capacitor 47, and a source of transistors 45, 52, and 63. A drain of transistor 45 is commonly connected to a second terminal of capacitor 47, and a drain of transistor 51. A source of transistor 51 is connected to a drain of transistor 52. A gate of transistor 52 is connected to the output of inverter 53 which has an input connected to a node 54. Node 54 is connected to the drain of transistors 63, 57, and 62. A source of transistor 62 is commonly connected to input 21, a source of transistors 57 and 61, a voltage input of reference 28, and a drain of transistor 59. Optional transistor 36 has a gate connected to the gate of transistor 63, a drain connected to output 24, and a source connected to return 22.

Figure 4:
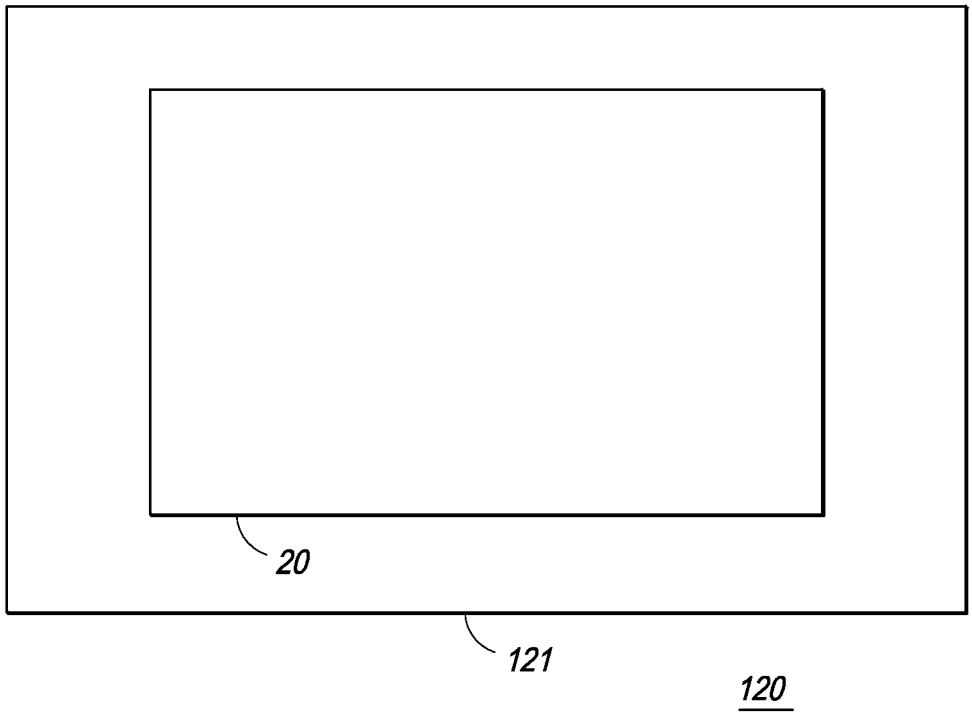
FIG. 4 illustrates an enlarged plan view of a semiconductor device that includes the linear power system of FIG. 1 and/or FIG. 2 in accordance with the present invention.

FIG. 4 illustrates an enlarged plan view of a portion of an embodiment of a semiconductor device or integrated circuit 120 that is formed on a semiconductor die 121. Controller 20 and/or controller 105 may be formed on die 121. Die 121 may also include other circuits that are not shown in FIG. 4 for simplicity of the drawing. Controller 20 and device or integrated circuit 120 are formed on die 121 by semiconductor manufacturing techniques that are well known to those skilled in the art.

In one embodiment, controller 20 may be formed on a semiconductor substrate as an integrated circuit having only four external leads.

From all the foregoing, one skilled in the art will understand that in one embodiment, a linear power supply controller may comprise:

a series pass transistor, such as transistor 30, coupled to receive an input voltage, such as the voltage on input 11, and to control an input current, current 23 for example, to regulate an output voltage, such as the voltage on output 24, to a desired value, the series pass transistor having a control electrode, a first current carrying electrode and a second current carrying electrode;

a feedback node, node 34 for example, configured to form a feedback signal that is representative of the output voltage wherein the linear power supply controller is configured to regulate a voltage on the control electrode of the series pass transistor in response to the feedback signal;

an enable input configured to receive an enable signal, such as signal EN on input 26, wherein the linear power supply controller is configured to inhibit enabling the series pass transistor in response to a negated state of the enable signal;

a soft-start circuit, circuit 40 for example, configured to form a ramp signal, such as the control signal 48, that varies at a first rate responsively to an asserted state of the enable signal; and an enable transistor, transistor 59 for example, coupled to the control electrode of the series pass transistor wherein the enable transistor is configured to vary a voltage on the control electrode of the series pass transistor responsively to the variation of the ramp signal and independently of a value of the feedback signal until a difference between the ramp signal and a deviation from the desired value of the output voltage reaches a threshold voltage of the enable transistor.

In another embodiment, the difference between the ramp signal and the deviation from the desired value of the output voltage becomes either no greater than or less than the threshold voltage of the enable transistor.

Those skilled in the art will also appreciate that another embodiment may include a ramp capacitor configured to be charged responsively to the negated state of the enable signal and to be discharged at the first rate responsively to the asserted state of the enable signal.

Another embodiment may further include that the soft-start circuit is configured to vary the ramp signal at a second rate that is less than the first rate responsively to a first value of the ramp signal An alternate embodiment may include that the enable transistor includes a first current carrying electrode coupled to receive the input voltage, a second current carrying electrode coupled to the control electrode of the series pass transistor, and a control electrode coupled to receive the ramp signal.

A further embodiment may include that the soft-start circuit includes a ramp capacitor having a first terminal coupled to the control electrode of the enable transistor and configured to be charged responsively to the negated state of the enable signal, and a second terminal coupled to a voltage return of the linear power supply controller.

Those skilled in the art will appreciate that an embodiment of one method of forming a linear power supply controller may comprise:

forming the liner power supply controller to receive an input voltage and to control an output current, current 17 for example, through a pass transistor, such as transistor 30, to regulate an output voltage, the voltage on output 24 for example, to a desired value;

configuring the linear power supply controller to receive an enable signal, such as the EN signal;

configuring the linear power supply controller to use a feedback signal, the FB signal for example, that is representative of the output voltage to form an error signal that is representative of a deviation of the output voltage from the desired of the output voltage;

configuring a soft-start circuit of the linear power supply controller to form a control signal, control signal 48 for example, responsively to the enable signal wherein the control signal varies from a first value to a second value; and configuring the soft-start circuit to control the pass transistor to form the output current responsively to the control signal and independently of a value of the output voltage until the control signal is less than the error signal.

Another embodiment of the method may include configuring the soft-start circuit to form the control signal as one of an asymptotically varying signal or a ramp signal responsively to the enable signal and to control the pass transistor responsively to one of the asymptotically varying signal or the ramp signal.

A further embodiment of the method may include configuring the soft-start circuit to vary the control signal at a first rate and to vary the control signal at a second rate responsively to the control signal reaching a first value.

One skilled in the art will also appreciate that another method of forming a linear power supply controller may comprise:

configuring a pass transistor to receive an input voltage and control an input current to regulate an output voltage to a desired value, the pass transistor having a control electrode, a first current carrying electrode and a second current carrying electrode;

configuring the linear power supply controller to use a feedback signal, the FB signal for example, that is representative of the output voltage;

configuring an enable input to receive an enable signal, such as the EN signal;

configuring the linear power supply controller to inhibit enabling the pass transistor in response to a negated state of the enable signal; and configuring a soft-start circuit to form a control signal, such as signal 48, responsively to an asserted state of the enable signal wherein the soft-start circuit forms the control signal to vary from a first value to a second value at a first rate including configuring the linear power supply controller to vary a voltage on the control electrode of the pass transistor at the first rate.

In another embodiment, the method may include configuring the linear power supply controller to vary the voltage on the control electrode of the pass transistor at the first rate independently of a value of the feedback signal until a difference between the control signal and a deviation of the output voltage from the desired value reaches a threshold value, such as the output threshold of circuit 40.

In another embodiment, the output threshold value of circuit 40 becomes less than the difference between the control signal and the deviation of the output voltage from the desired value.

A further embodiment of the method may also include configuring the soft-start circuit to form the control signal to vary at a second rate that is less than the first rate responsively to the second value of the control signal, such as after T2 in FIG. 3.

Another embodiment of the method may include configuring the soft-start circuit to discharge a capacitor at a first current value for the first rate and to discharge the capacitor at a second current value for the second rate.

In view of all of the above, it is evident that a novel device and method is disclosed. Included, among other features, is a method of forming a power supply controller that includes configuring the power supply controller to form a control signal responsively to an asserted state of the enable signal and to form the control signal to vary from a first value to a second value at a first rate including configuring the power supply controller to vary the input current at the first rate to minimize the value of the inrush current of the input current.

While the subject matter of the descriptions are described with specific preferred embodiments and example embodiments, the foregoing drawings and descriptions thereof depict only typical and exemplary embodiments of the subject matter and are not therefore to be considered to be limiting of its scope, it is evident that many alternatives and variations will be apparent to those skilled in the art. As will be appreciated by those skilled in the art, the example form of system 10 and controller 20 are used as a vehicle to explain the method of forming controller 20 to control the value of the inrush current. Those skilled in the art will appreciate that the waveshape of signal 48 and the implementation of circuit 40 may have various implementations instead of the example implementation illustrated in FIGS. 2 and 3.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. A linear power supply controller comprising:

a series pass transistor coupled to receive an input voltage and to control an input current to regulate an output voltage to a desired value, the series pass transistor having a control electrode, a first current carrying electrode and a second current carrying electrode;

a feedback node configured to form a feedback signal that is representative of the output voltage wherein the linear power supply controller is configured to regulate a voltage on the control electrode of the series pass transistor in response to the feedback signal;

an enable input configured to receive an enable signal wherein the linear power supply controller is configured to inhibit enabling the series pass transistor in response to a negated state of the enable signal;

a soft-start circuit configured to form a ramp signal that varies at a first rate responsively to an asserted state of the enable signal;

an enable transistor coupled to the control electrode of the series pass transistor wherein the enable transistor is configured to vary a voltage on the control electrode of the series pass transistor responsively to the variation of the ramp signal and independently of a value of the feedback signal until a difference between the ramp signal and a deviation from the desired value of the output voltage reaches a threshold voltage of the enable transistor; and wherein the soft-start circuit configured to vary the ramp signal at a second rate responsively to a first value of the ramp signal.

2. The linear power supply controller of claim 1 wherein the soft-start circuit includes a ramp capacitor configured to be charged responsively to the negated state of the enable signal and to be discharged at the first rate responsively to the asserted state of the enable signal.

3. The linear power supply controller of claim 1 wherein the second rate is less than the first rate.

4. The linear power supply controller of claim 1 wherein the soft-start circuit includes a ramp generator configured to form the ramp signal to enable the enable transistor responsively to the asserted state of the enable signal.

5. The linear power supply controller of claim 1 wherein the first current carrying electrode of the enable transistor is coupled to receive the input voltage, the second current carrying electrode is coupled to the control electrode of the series pass transistor, and the control electrode is coupled to receive the ramp signal.

6. The linear power supply controller of claim 5 wherein the soft-start circuit includes a ramp capacitor having a first terminal coupled to the control electrode of the enable transistor and configured to be charged responsively to the negated state of the enable signal, and a second terminal coupled to a voltage return of the linear power supply controller.

7. The linear power supply controller of claim 6 wherein the soft-start circuit includes a current source, a first transistor coupled to form a first current to discharge the ramp capacitor responsively to the asserted state of the enable signal and a second transistor coupled to form a second current to discharge the ramp capacitor until a value of the ramp signal becomes the first value.

8. The linear power supply controller of claim 7 wherein the first transistor includes a first current carrying electrode coupled to a first terminal of the ramp capacitor, a second current carrying electrode coupled to a voltage return of the linear power supply controller, and also includes a control electrode, and wherein the second transistor includes a control electrode coupled to receive a detect signal representative of the ramp signal becoming the first value, a first current carrying electrode coupled to receive the second current, and a second current carrying electrode coupled to the voltage return.

9. The linear power supply controller of claim 8 further including a third transistor having a first current carrying electrode coupled to the first current carrying electrode of the second transistor, a second current carrying electrode coupled to the first terminal of the ramp capacitor, and a control electrode coupled to the control electrode of the first transistor.

10. The linear power supply controller of claim 9 further including a fourth transistor coupled in a current mirror configuration with the first and third transistors, the fourth transistor having a first current carrying electrode coupled to receive a source current from current source, a second current carrying electrode coupled to the voltage return, and a control electrode coupled to the control electrode of the first transistor.

11. A method of forming a linear power supply controller comprising:

forming the liner power supply controller to receive an input voltage and to control an output current through a pass transistor to regulate an output voltage to a desired value;

configuring the linear power supply controller to receive an enable signal;

configuring the linear power supply controller to use a feedback signal that is representative of the output voltage to form an error signal that is representative of a deviation of the output voltage from the desired value of the output voltage;

configuring a soft-start circuit of the linear power supply controller to form a control signal responsively to the enable signal wherein the control signal varies from a first value to a second value;

configuring the soft-start circuit to control the pass transistor to form the output current responsively to the control signal and independently of a value of the output voltage until the control signal is less than the error signal; and configuring the soft-start circuit to vary the control signal at a first rate and to vary the control signal at a second rate responsively to the control signal.

12. The method of claim 11 wherein configuring the soft-start circuit to control the pass transistor includes configuring the soft-start circuit to form the control signal as one of an asymptotically varying signal or a ramp signal responsively to the enable signal and to control the pass transistor responsively to one of the asymptotically varying signal or the ramp signal.

13. The method of claim 12 wherein configuring the soft-start circuit to form the control signal as the ramp signal includes configuring the soft-start circuit to charge a capacitor responsively to a negated state of the enable signal, to discharge the capacitor responsively to an asserted state of the enable signal, and to control the pass transistor responsively to the ramp signal.

14. The method of claim 11 wherein configuring the soft-start circuit to vary the control signal at the first rate and to vary the control signal at the second rate includes configuring the soft-start circuit to vary the control signal at the second rate responsively to the control signal reaching the first value.

15. The method of claim 14 wherein configuring the soft-start circuit to vary the control signal at the first rate and to vary the control signal at the second rate responsively to the control signal reaching the first value includes configuring the soft-start circuit to discharge a capacitor with a first current responsively to an asserted state of the enable signal, and to discharge the capacitor with a second current that is less than the first current responsively to the capacitor discharging to the first value.

16. A method of forming a linear power supply controller comprising:

configuring a pass transistor to receive an input voltage and control an input current to regulate an output voltage to a desired value, the pass transistor having a control electrode, a first current carrying electrode and a second current carrying electrode;

configuring the linear power supply controller to use a feedback signal that is representative of the output voltage;

configuring an enable input to receive an enable signal;

configuring the linear power supply controller to inhibit enabling the pass transistor in response to a negated state of the enable signal; and configuring a soft-start circuit to form a control signal responsively to an asserted state of the enable signal wherein the soft-start circuit forms the control signal to vary from a first value to a second value at a first rate including configuring the linear power supply controller to vary a voltage on the control electrode of the pass transistor at the first rate including configuring the soft-start circuit to form the control signal to vary at a second rate responsively to the control signal.

17. The method of claim 16 wherein configuring the soft-start circuit to form the control signal includes configuring the linear power supply controller to vary the voltage on the control electrode of the pass transistor at the first rate independently of a value of the feedback signal until a difference between the control signal and a deviation of the output voltage from the desired value reaches a threshold value.

18. The method of claim 17 wherein configuring the linear power supply controller to vary the voltage on the control electrode of the pass transistor includes configuring the linear power supply controller to control the pass transistor responsively to the feedback signal subsequently to the difference between the control signal and the deviation of the output voltage from the desired value reaching the threshold value.

19. The method of claim 16 wherein configuring the soft-start circuit to form the control signal includes configuring the soft-start circuit to form the control signal to vary at the second rate that is less than the first rate responsively to the second value of the control signal.

20. The method of claim 19 wherein configuring the soft-start circuit to form the control signal to vary at the second rate includes configuring the soft-start circuit to discharge a capacitor at a first current value for the first rate and to discharge the capacitor at a second current value for the second rate.

* * * * *